US010232629B2

(12) United States Patent
Boyd et al.

(10) Patent No.: US 10,232,629 B2
(45) **Date of Patent: *Mar. 19, 2019**

(54) CONTAINER ASSEMBLY

(71) Applicant: HEWLETT-PACKARD DEVELOPMENT COMPANY, L.P., Houston, TX (US)

(72) Inventors: Patrick V. Boyd, Albany, OR (US); Mike M. Morrow, Salem, OR (US); David Olsen, Corvallis, OR (US); Milo A. Undlin, Corvallis, OR (US); Steven T. Castle, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/889,289

(22) Filed: Feb. 6, 2018

(65) Prior Publication Data

US 2018/0154643 A1 Jun. 7, 2018

Related U.S. Application Data

(63) Continuation of application No. 15/308,005, filed as application No. PCT/US2014/044324 on Jun. 26, 2014, now Pat. No. 9,925,782.

(51) Int. Cl.
*B41J 2/175* (2006.01)

(52) U.S. Cl.
CPC ..... *B41J 2/17523* (2013.01); *B41J 2/1753* (2013.01); *B41J 2/17553* (2013.01)

(58) Field of Classification Search
CPC .. B41J 2/17513; B41J 2/1753; B41J 2/17523; B41J 2/17553; B41J 31/02
(Continued)

(56) References Cited

U.S. PATENT DOCUMENTS 5,969,735 A 10/1999 Haigo
6,015,209 A 1/2000 Barinaga et al.
(Continued)

FOREIGN PATENT DOCUMENTS

CN 1302933 7/2001
CN 1511087 7/2004
(Continued)

OTHER PUBLICATIONS

European Patent Office, Extended European Search Report for Appl. No. EP 14896123.8 dated Jan. 3, 2018 (10 pages).
(Continued)

*Primary Examiner* — Huan H Tran
*Assistant Examiner* — Alexander D Shenderov
(74) *Attorney, Agent, or Firm* — HP Inc. Patent Department

(57) ABSTRACT

In some examples, a container assembly includes a first body to supply a printing composition, the first body comprising a first port, and the container assembly includes a second body to store a reserve printing composition, the second body comprising a second port. An interconnect has a storage position to fluidically isolate the first body from the second body, and a use position to fluidically connect the first body to the second body to allow the reserve printing composition to flow from the second body to the first body to replenish the printing composition in the first body and to allow air in the first body displaced by the reserve printing composition to flow from the first body to the second body. The interconnect in the storage position has a first orientation to fluidically isolate the first port from the second port, and the interconnect in the use position has a second orientation rotated with respect to the first orientation to fluidically connect the first port to the second port.

14 Claims, 5 Drawing Sheets

(58) Field of Classification Search
USPC ..... 347/86
See application file for complete search history.

(56) References Cited

U.S. PATENT DOCUMENTS

| | | | | |
|---|---|---|---|---|
| 6,022,102 | A | 2/2000 | Ikkatai et al. | |
| 6,106,109 | A * | 8/2000 | Olazabal | B41J 2/17509 347/85 |
| 6,290,343 | B1 | 9/2001 | Lewis et al. | |
| 6,464,346 | B2 | 10/2002 | Otis, Jr. et al. | |
| 6,779,875 | B2 | 8/2004 | Pawlowski et al. | |
| 6,972,955 | B2 | 12/2005 | Pleskach et al. | |
| 7,771,020 | B2 | 8/2010 | Miyazaki et al. | |
| 8,657,424 | B2 | 2/2014 | Rittgers et al. | |
| 2003/0202062 | A1 | 10/2003 | Steinmetz et al. | |
| 2004/0061748 | A1 * | 4/2004 | Kuwabara | B41J 2/17509 347/85 |
| 2004/0090501 | A1 | 5/2004 | Yoshida et al. | |
| 2005/0068385 | A1 | 3/2005 | Nanjo | |
| 2005/0068394 | A1 | 3/2005 | Inoue et al. | |
| 2006/0017787 | A1 | 1/2006 | Inoue et al. | |
| 2006/0044369 | A1 | 3/2006 | Mutoh et al. | |
| 2010/0245495 | A1 | 9/2010 | Katada et al. | |
| 2012/0133714 | A1 | 5/2012 | McCracken et al. | |

FOREIGN PATENT DOCUMENTS

| | | | |
|---|---|---|---|
| JP | 57-24283 | A | 2/1982 |
| JP | S5857961 | | 4/1983 |
| JP | 58-171965 | A | 10/1983 |
| JP | 58-194560 | A | 11/1983 |
| TW | 201242787 | A | 11/2012 |

OTHER PUBLICATIONS

Korean Intellectual Property Office, International Search Report and Written Opinion for PCT/US2014/044324 dated Mar. 27, 2015 (12 pages).

* cited by examiner

CONTAINER ASSEMBLY

CROSS REFERENCE TO RELATED APPLICATIONS

This is a continuation of U.S. application Ser. No. 15/308,005, having a national entry date of Oct. 31, 2016, which is a national stage application under 35 U.S.C. § 371 of PCT/US2014/044324, filed Jun. 26, 2014, which are both hereby incorporated by reference in their entirety.

BACKGROUND

End users appreciate ease of use and robust components for their printing devices. They also appreciate flexibility and cost-effective solutions for their printing needs. Designers and manufacturers may, therefore, endeavor to create and provide printing device components directed toward at least some of these objectives.

BRIEF DESCRIPTION OF THE DRAWINGS

The following detailed description references the drawings, wherein.

DETAILED DESCRIPTION

Printing devices deposit printing composition onto media. Printing devices may utilize printheads to deposit the printing composition onto the media. The printing composition for these printheads may be stored in and supplied by container assemblies.

The quantity of printing composition that end users may require varies. Providing a flexible and modular approach to such end users that allows them to choose the amount of printing composition they want to utilize may be useful to them. However, as the size of a container assembly increases, the thickness of its walls may also increase to provide sufficient structural strength to accommodate the increased volume load placed on these walls. These thicker walls may result in an increase in material cost which can raise the price end users may have to pay for container assemblies.

Accordingly, the present disclosure provides container assemblies such as those examples shown in FIGS. 1-5. These container assemblies provide a modular and flexible approach that allows an end user to choose the amount of printing composition to use. These container assemblies may use existing interfaces for connecting the container assemblies to the printheads of a printing device. This helps save cost associated with this choice which may unduly increase if specially designed interfaces are required to connect these container assemblies to the printheads of a printing device.

These modular and flexible container assemblies may also be robust. Such robustness may include secure connections between any submodules and fluidic interfaces, as well as compliance during end user handling.

As used herein the term "printing device" represents a printer, plotter, press and/or device that uses any of the following marking technologies or a combination thereof: ink jet, dye sublimation, thermal transfer, 3D, laser, extrusion, off-set printing, dot matrix, or other suitable marking technologies. As used herein the terms "media" and "medium" are interchangeable and represent any type of paper or other printing medium (e.g., cloth, cardboard, canvas, transparency, substrate, powder, etc.), having any type of finish on either or both sides (e.g., glossy, matte, plain, textured, etc.), in any size, shape, color, or form (e.g., sheet, roll (cut or uncut), folded, etc.) on which printing composition (e.g., ink, toner, colorant, wax, dye, powder, latex, printing fluid or solid, etc.) is placed, jetted, deposited, dropped, ejected, formed, or laid to create text or items (e.g., text, images, graphics, pictures, formulas, charts, two-dimensional objects, three-dimensional objects, etc.). As used herein, the terms "printhead" and "printheads" represent a mechanism or device that implements any of the above-described marking technologies. A print head or print heads can be a single device or mechanism, or arranged in a module or array such as, for example, a print bar or page-wide array.

Figure 1:
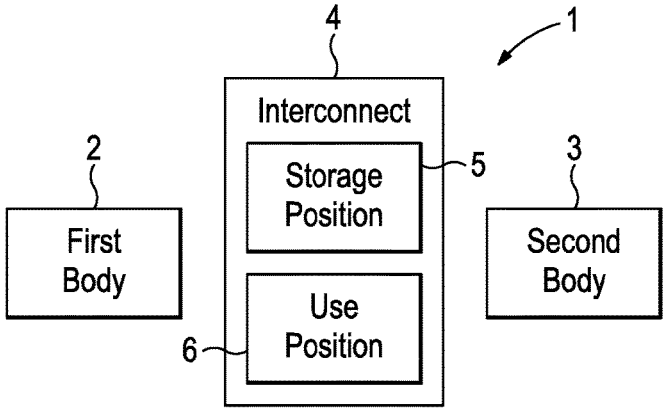
FIG. 1 is an example of a diagram of a container assembly.

An example of a diagram of a container assembly 1 is shown in FIG. 1. As can be seen in FIG. 1, container assembly 1 includes a first body 2 to supply printing composition and a second body 3 to store reserve printing composition. As can also be seen in FIG. 1, container assembly 1 additionally includes an interconnect 4 having a storage position 5 to fluidically isolate first body 2 from second body 3. Storage position 5 helps retain printing composition in first body 2 and reserve printing composition in second body 3. As can additionally be seen in FIG. 1, interconnect 4 also includes a use position 6 to fluidically connect first body 2 to second body 3 to allow the reserve printing composition to flow from second body 3 to first body 2 as needed to replenish the printing composition in first body 2 and to allow air in first body 2 displaced by the reserve printing composition to flow from first body 2 to second body 3.

Figure 2:
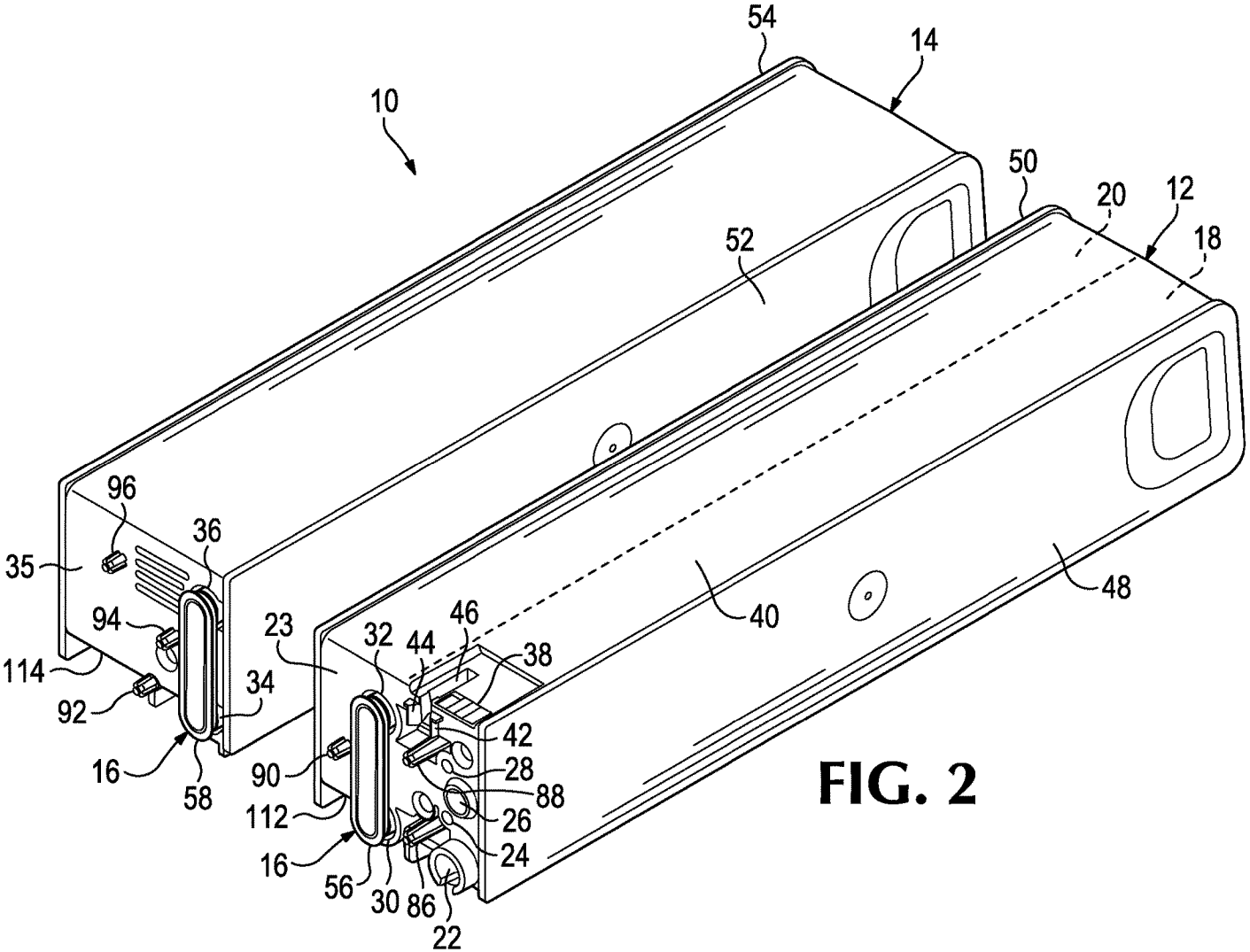
FIG. 2 is an example of a perspective view of a container assembly.

A perspective view of an example of a container assembly 10 is shown in FIG. 2. As can be seen in FIG. 2, container assembly 10 includes a first body 12 to supply printing composition to a printing device. Container assembly 10 also includes a second body 14 to store reserve printing composition. Container assembly 10 additionally includes an interconnect 16 having a storage position (as shown) to fluidically isolate first body 12 from second body 14.

As can also be seen in FIG. 2, first body 12 includes a regulated tank 18 and a free tank 20. Regulated tank 18 includes a regulator assembly (not shown) that helps to regulate the flow of printing composition from free tank 20 to regulated tank 18. Free tank 20 does not include a regulator assembly. First body 12 includes a printer supply port 22 located on a side 23 of first body 12 that fluidically connects to a printing device to supply printing composition from regulated tank 18 to the printing device. Regulated tank 18 also includes an ambient port 24 located on side 23 of first body 12 to help regulate the flow of printing composition from free tank 20 to regulated tank 18. Regulated tank 18 additionally includes an inflation port 26 located on side 23 of first body 12 that fluidically connects to a supply of air (not shown) to help prime first body 12 so that it supplies printing composition to a printing device. Regulated tank 18 further includes an ambient port 28 located on side 23 of first body 12 that allows a regulator assembly (not shown) in regulated tank 18 to expand by drawing in air via ambient port 28 and collapse by forcing air out of ambient port 28. The regulator assembly in conjunction with ambient port 24 helps to regulate the flow of printing composition from free tank 20 to regulated tank 18.

As can additionally be seen in FIG. 2, first body 12 includes a printing composition replenishment port 30 on side 23 of first body 12 that is fluidically coupled to free tank 20. First body 12 also includes a first air port 32 on side 23 of first body 12 that is fluidically coupled to free tank 20. Second body 14 includes a tank (not shown) that stores the reserve printing composition. Second body 14 also includes a printing composition supply port 34 on side 35 of second body 14 and a second air port 36 on side 35 of second body 14. The storage position of interconnect 16, shown in FIG. 2, fluidically connects printing composition replenishment port 30 to first air port 32 of first body 12 to retain printing composition in free tank 20 and fluidically connects printing composition replenishment port 34 to second air port 36 of second body 14 to retain the reserve printing composition therein.

As can further be seen in FIG. 2, first body 12 includes a memory 38 on a top surface 40 thereof that stores information that can be retrieved from memory 38 and utilized by a printing device. Information may also be written to memory 38 by a printing device. First body 12 also includes datums 42, 44, and 46 that are used to help properly position first body 12 during its connection to a printing device. As can further be seen in FIG. 2, first body 12 includes a pair of lids 48 and 50 that help to seal regulated tank 18 and free tank 20. Second body 14 also includes a pair of lids 52 and 54 that help to seal second body 14.

Figure 3:
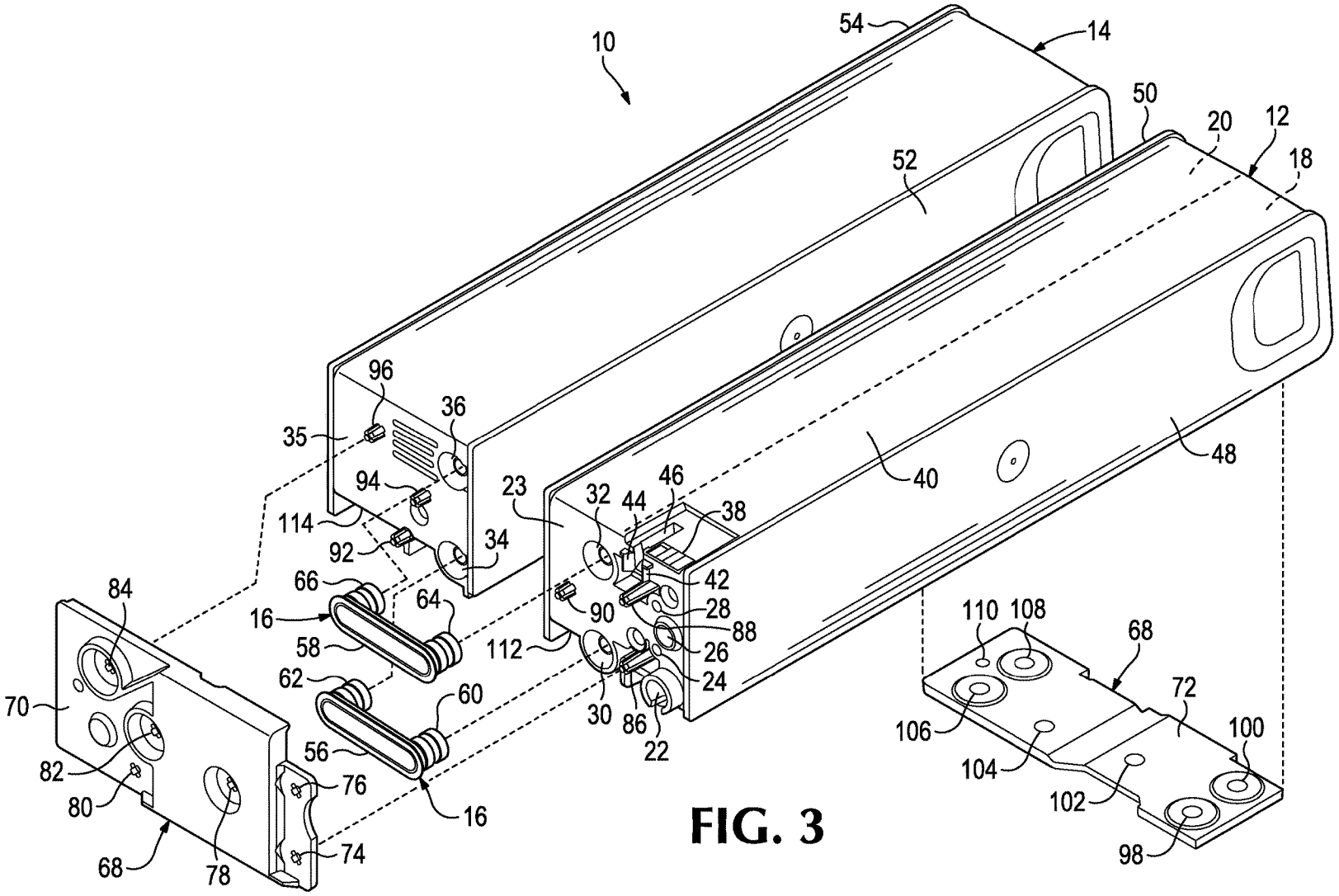
FIG. 3 is an example of an exploded perspective view of a container assembly.

An example of an exploded perspective view of container assembly 10 is shown in FIG. 3. As can be seen in FIG. 3, interconnect 16 includes a printing composition link 56 and an air link 58. Interconnect 16 also includes a plurality of elastomeric boots 60 and 62 positioned between the printing composition link 56 and the respective first and second bodies 12 and 14 to help seal connections between printing composition link 56 and the respective first and second bodies 12 and 14, as well as provide compliance during end user handling. Interconnect 16 also includes a plurality of elastomeric boots 64 and 66 positioned between the air link 58 and the respective first and second bodies 12 and 14 to help seal connections between air link 58 and the respective first and second bodies 12 and 14, as well as provide compliance during end user handling.

As can also be seen in FIG. 3, container assembly 10 additionally includes a coupler 68 to join first body 12 and second body 14 together. Coupler 68 also applies a bias force against printing composition link 56, air link 58, and elastomeric boots 60, 62, 64 and 66 of interconnect 16 in the use position (see e.g., FIG. 5) to help maintain a fluidic connection between first body 12 and second body 14. Coupler 68 includes a clamp plate 70 and a bottom plate 72. Clamp plate 70 includes a plurality of apertures 74, 76, 78, 80, 82, and 84 in which respective heat stakes 86, 88, 90, 92, 94, and 96 on first and second bodies 12 and 14 are disposed to attach clamp plate 70 to first and second bodies 12 and 14. Bottom plate 72 also includes a plurality of apertures 98, 100, 102, 104, 106, 108, and 110 in which heat stakes (not shown) on respective bottom surfaces 112 and 114 of first and second bodies 12 and 14 are disposed to attach bottom plate 72 to first and second bodies 12 and 14.

Figure 4:
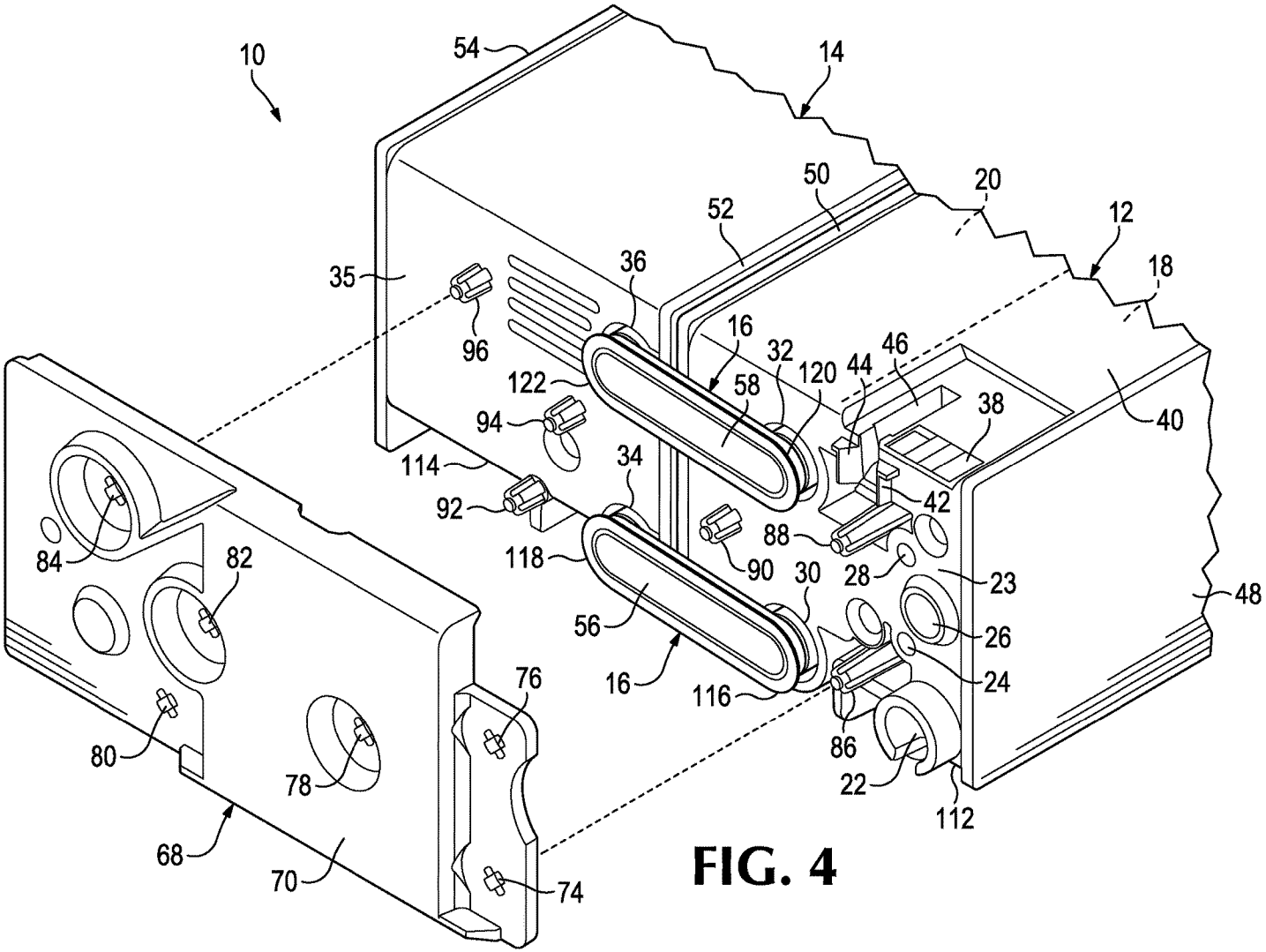
FIG. 4 is an example of an enlarged, exploded, fragmented perspective view of a container assembly.

An example of an enlarged, exploded, fragmented perspective view of container assembly 10 is shown in FIG. 4. As can be seen in FIG. 4, interconnect 16 also has a use position (as shown) to fluidically connect first body 12 to second body 14. This use position of interconnect 16 allows reserve printing composition stored in second body 14 to flow (e.g., under the influence of gravity) from second body 14 to free tank 20 of first body 12 as needed to replenish the printing composition in first body 12 used by a printing device to which container assembly 10 is connected via printer supply port 22. The use position of interconnect 16 also allows air in free tank 20 of first body 12 displaced by the reserve printing composition to flow from free tank 20 of first body 12 to second body 14.

As can also be seen in FIG. 4, in the use position, printing composition link 56 of interconnect 16 is fluidically connected to both printing composition replenishment port 30 of first body 12 and to printing composition supply port 34 of second body 14. As can additionally be seen in FIG. 4, in the use position, air link 58 of interconnect 16 is fluidically connected to both first air port 32 of first body 12 and to second air port 36 of second body 14. These fluidic connections are established by placing end 116 of printing composition link 56 and elastomeric boot 60 in printing composition replenishment port 30, end 118 of print composition link 56 and elastomeric boot 62 in printing composition replenishment port 34, end 120 of air link 58 and elastomeric boot 64 in first air port 32, and end 122 of air link 58 and elastomeric boot 66 in second air port 36.

Figure 5:
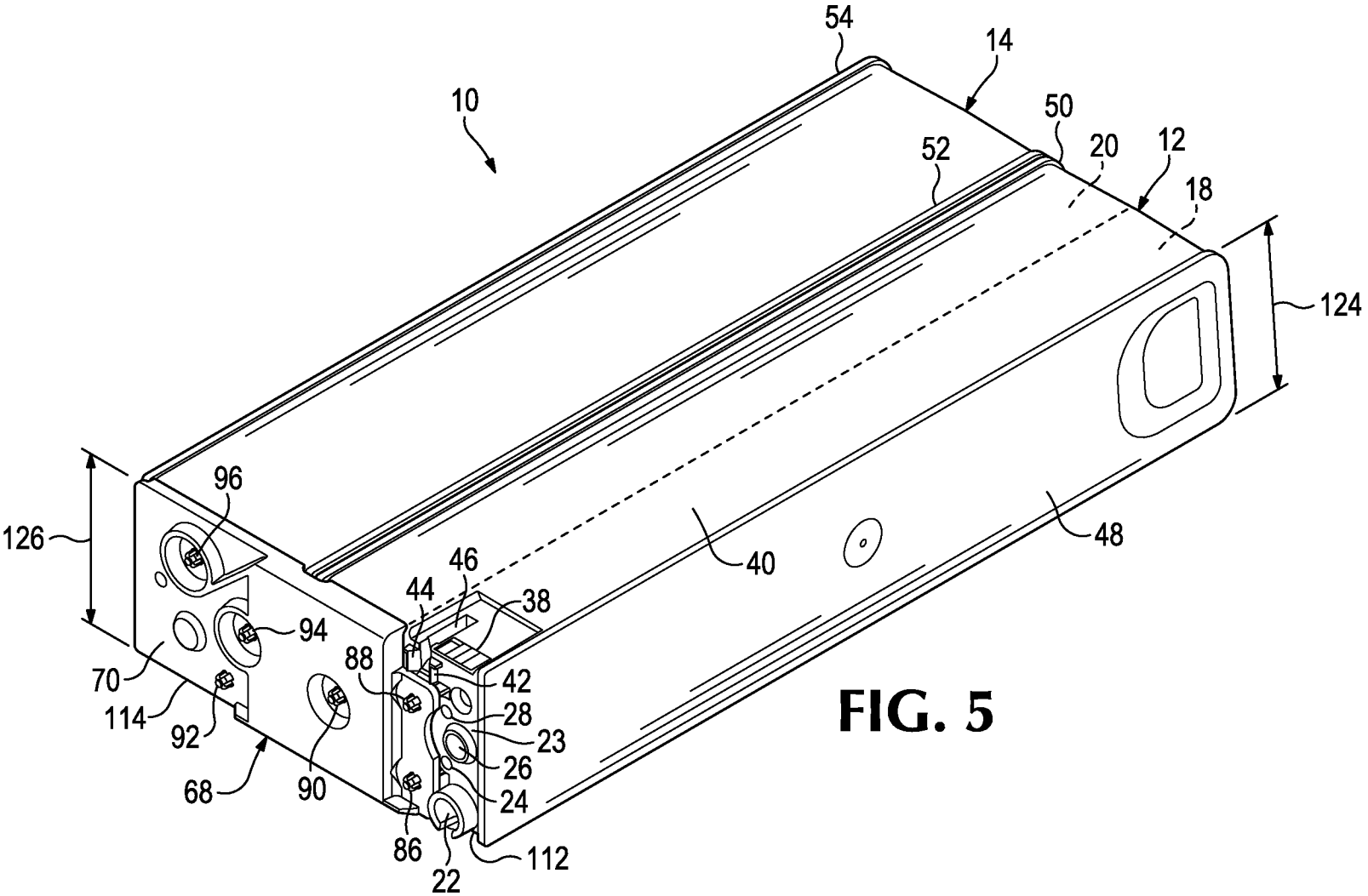
FIG. 5 is an example of a perspective view of the container assembly of FIG. 2 in an assembled condition.

An example of a perspective view of container assembly 10 in an assembled, use condition is shown in FIG. 5. As can be seen in FIG. 5, clamp plate 70 of coupler 68 has been attached to heat stakes 86, 88, 90, 92, 94, and 96 to join respective first and second bodies 12 and 14 together. Clamp plate 70 of coupler 68 is also applying a biasing force against interconnect 16 in the use position to help maintain the fluidic connections between first body 12 and second body 14. As can also be seen in FIG. 5, clamp plate 70 is also covering interconnect 16 to help protect it against accidental or inadvertent disconnection for first body 12 and/or second body 14. This provides a robust container assembly 10 solution that helps to prevent printing composition in first body 12 or second body 14 of container assembly 10 from spilling out which is wasteful and may result in damage to a printing device. Clamp plate 70 and bottom plate 72 of coupler 68 also help provide a secure mechanical connection between first body 12 and second body 14 which enhances the robustness of container assembly 10.

As can additionally be seen in FIG. 5, clamp plate 70 of coupler 68 provides clearance for each of printer supply port 22, ambient port 24, inflation port 26, and ambient port 28 so that these ports may still function as originally designed for first body 12. Clamp plate 70 additionally provides clearance for datums 42, 44, and 46 so that they may still function as originally designed. These clearances provided by clamp plate 70 allow the same first body 12 to be used in a printing device with or without second body 14 which means that a specially designed first body 12 is unnecessary for use with container assembly 10. This helps save cost and also provides additional flexibility to end users.

As can further be seen in FIG. 5, both first body 12 and second body 14 each have a respective width 124 and 126. Widths 124 and 126 allow respective first and second bodies 12 and 14 of container assembly 10 to hold and provide a predetermined quantity of printing composition to an end user. This allows container assembly 10 to provide a modular and flexible solution to the different printing needs of various end users. For example, both widths 124 and 126 may be approximately 32 millimeters (mm). However, in other examples, first body 12 and/or second body 14 of container assembly 10 may have smaller or larger widths (e.g., approximately 25 mm or 50 mm). Additionally, in such other examples, widths 124 and 126 of respective first body 12 and second body 14 do not have to be of the same dimensions. For example, width 124 may be approximately 50 mm and width 126 may be approximately 25 mm. Container assembly 10 provides this modular and flexible advantage while, at the same time, utilizing a common mechanical connection (e.g., coupler 68) and fluidic interface (e.g., interconnect 16) for these different possible width combinations which saves cost and also provides ease of use to end users who need to utilize one relatively simple common mechanical connection and fluidic interface.

As can also further be seen in FIG. 5, container assembly 10 provides a modular and flexible solution through the use of mechanically connected and fluidically interfaced submodules (e.g., first body 12 and second body 14) that also saves cost over an approach that utilizes a single larger module to achieve the same printing composition storage volume. This cost savings results because a single larger module would require that the walls of its tank be relatively thicker than the walls of the submodules of first body 12 and second body 14 in order to provide sufficient structural strength to accommodate the increased volume load placed on the walls of such a single larger module. Such thicker walls may result in increased material cost.

Although several drawings have been described and illustrated in detail, it is to be understood that the same are intended by way of illustration and example. These examples are not intended to be exhaustive or to be limited to the precise form disclosed. Modifications, additions and variations may well be apparent. For example, printer supply port 22, ambient port 24, inflation port 26, ambient port 28, printing composition replenishment port 30, first air port 32, printing composition supply port 34 and/or second air port 36 may be in a different location on first body 12 or second body 14 than as shown and described above. As another example, although one second body 14 is illustrated in use with first body 12, it is to be understood that other container assemblies may utilize at least one additional second body connected to and fluidically interfaced with first body 12 or second body 14. As an additional example, first and second bodies 12 and 14 can be joined in other or additional ways than through the use of a coupler 68 (e.g., through the use of adhesive, plastic swaging, laser welding, ultrasonic welding, hot plate welding, induction welding and/or microwave welding). As a further example, in the use position of container assembly 10, reserve printing composition stored in second body 14 may flow from second body 14 to free tank 20 of first body 12 as needed to replenish the printing composition in first body 12 based on a pressure differential between free tank 20 of first body 12 and second body 14. As yet a further example, first body 12 of container assembly 10 does not have to include regulated tank 18, ambient port 24, inflation port 26, ambient port 28 and/or a regulator assembly.

Additionally, reference to an element in the singular is not intended to mean one, unless explicitly so stated, but rather means at least one. Furthermore, unless specifically stated, any method elements are not limited to the sequence or order described and illustrated. Moreover, no element or component is intended to be dedicated to the public regardless of whether the element or component is explicitly recited in the following claims.

What is claimed is:

1. A container assembly, comprising:

a first body to supply a printing composition, the first body comprising a first port;

a second body to store a reserve printing composition, the second body comprising a second port;

an interconnect having a storage position to fluidically isolate the first body from the second body, and a use position to fluidically connect the first body to the second body to allow the reserve printing composition to flow from the second body to the first body to replenish the printing composition in the first body and to allow air in the first body displaced by the reserve printing composition to flow from the first body to the second body, the interconnect in the storage position having a first orientation to fluidically isolate the first port from the second port, and the interconnect in the use position having a second orientation rotated with respect to the first orientation to fluidically connect the first port to the second port; and a coupler to join the first body and the second body together and to apply a biasing force against the interconnect in the use position to maintain the fluidic connection between the first body and the second body, wherein the coupler comprises:

a bottom plate attached to the first body and the second body, and a clamp plate attached to the first body and the second body, the clamp plate to apply the biasing force against the interconnect.

2. The container assembly of claim 1, wherein the clamp plate covers the interconnect.

3. The container assembly of claim 1, wherein the reserve printing composition flows from the second port of the second body to the first port of the first body to replenish the printing composition in the first body when the interconnect is in the use position.

4. The container assembly of claim 3, wherein the first body comprises a first air port, and the second body comprises a second air port, and wherein the air in the first body displaced by the reserve printing composition flows from the first air port of the first body to the second air port of the second body when the interconnect is in the use position.

5. A container assembly, comprising:

a first body to supply a printing composition, the first body comprising a first port, a regulated tank, and a free tank;

a second body to store a reserve printing composition, the second body comprising a second port;

an interconnect having a storage position to fluidically isolate the first body from the second body, and a use position to fluidically connect the first body to the second body to allow the reserve printing composition to flow from the second body to the first body to replenish the printing composition in the first body and to allow air in the first body displaced by the reserve printing composition to flow from the first body to the second body, the interconnect in the storage position having a first orientation to fluidically isolate the first port from the second port, and the interconnect in the use position having a second orientation rotated with respect to the first orientation to fluidically connect the first port to the second port, and wherein the interconnect fluidically connects to the free tank of the first body.

6. The container assembly of claim 1, wherein the interconnect includes a printing composition link and an air link, and further wherein the interconnect includes a plurality of elastomeric boots to seal connections between the printing composition link and the first and second bodies and to seal connections between the air link and the first and second bodies.

7. A container assembly, comprising:

a first body including a printer supply port to supply a printing composition, a printing composition replenishment port, and a first air port, wherein the first body comprises:

a regulated tank including the printer supply port, and a free tank including the printing composition replenishment port and the first air port, wherein the regulated tank further includes an ambient port to regulate flow of the printing composition from the free tank to the regulated tank, and an inflation port to prime the first body to supply the printing composition via the printer supply port;

a second body to store a reserve printing composition, the second body including a printing composition supply port and a second air port; and an interconnect including a storage position to fluidically isolate the first body from the second body, and a use position to fluidically connect the first body to the second body to allow the reserve printing composition to flow from the printing composition supply port of the second body to the printing composition replenishment port of the first body to replenish the printing composition in the first body and to allow air in the first body displaced by the reserve printing composition to flow from the first air port of the first body to the second air port of the second body, the interconnect in the storage position having a first orientation to fluidically isolate the printing composition replenishment port from the printing composition supply port, and the interconnect in the use position having a second orientation rotated with respect to the first orientation to fluidically connect the printing composition replenishment port to the printing composition supply port.

8. The container assembly of claim 7, wherein the interconnect when in the storage position having the first orientation fluidically isolates the first air port from the second air port, and the interconnect when in the use position having the second orientation fluidically connects the first air port to the second air port.

9. The container assembly of claim 7, further comprising a coupler connected to the first body and the second body.

10. The container assembly of claim 9, wherein the coupler comprises a clamp plate attached to the first body and the second body, the clamp plate to apply a biasing force on the interconnect.

11. The container assembly of claim 7, wherein the interconnect includes a printing composition link that fluidically connects the printing composition replenishment port and the printing composition supply port in the use position.

12. The container assembly of claim 11, wherein the interconnect includes an air link that fluidically connects the first air port and the second air port in the use position.

13. The container assembly of claim 12, wherein the interconnect comprises:

elastomeric boots positioned between the printing composition link and the first and second bodies to provide seals between the printing composition link and the first and second bodies; and elastomeric boots positioned between the air link and the first and second bodies to provide seals between the air link and the first and second bodies.

14. A container assembly, comprising:

a first body including a printer supply port to supply a printing composition, a printing composition replenishment port, and a first air port;

a second body to store a reserve printing composition, the second body including a printing composition supply port and a second air port; and an interconnect including a storage position to fluidically isolate the first body from the second body, and a use position to fluidically connect the first body to the second body to allow the reserve printing composition to flow from the printing composition supply port of the second body to the printing composition replenishment port of the first body to replenish the printing composition in the first body and to allow air in the first body displaced by the reserve printing composition to flow from the first air port of the first body to the second air port of the second body, the interconnect in the storage position having a first orientation to fluidically isolate the printing composition replenishment port from the printing composition supply port, and the interconnect in the use position having a second orientation rotated with respect to the first orientation to fluidically connect the printing composition replenishment port to the printing composition supply port, wherein the printer supply port, the printing composition replenishment port, and the first air port are located on a same side of the first body, and the printing composition supply port and the second air port are located on a same side of the second body.

* * * * *